United States Patent [19]

Tomita

[11] 4,307,534

[45] Dec. 29, 1981

[54] CASH REGISTER TOY

[75] Inventor: Tohru Tomita, Tokyo, Japan

[73] Assignee: Takara Co., Ltd., Tokyo, Japan

[21] Appl. No.: 107,842

[22] Filed: Dec. 28, 1979

[51] Int. Cl.[3] ..... A63H 33/30; G09F 3/04

[52] U.S. Cl. ..... 46/39; 40/447; 235/1 E; 434/327

[58] Field of Search ..... 46/39, 1 R, 2, 3, 4, 46/5, 40; 235/1 E, 454; 40/450, 447, 451, 219, 490; 272/8 M, 8 D, 8.5; 35/9 D, 2; 273/161; 434/110, 232, 327

[56] References Cited

U.S. PATENT DOCUMENTS 3,828,720 8/1974 Herst ..... 40/447

4,195,423 4/1980 Iwao ..... 235/1 E

*Primary Examiner*—Gene Mancene

*Assistant Examiner*—Michael J. Foycik

*Attorney, Agent, or Firm*—Jackson, Jones & Price

[57] ABSTRACT

A toy having a chassis generally configured to simulate a cash register and a mechanism for numerically displaying a price of specific merchandise depicted on a card, is disclosed. The mechanism includes a first and a second panel of the chassis which define a slot wherein the card is at least partially positioned for pictorially displaying the merchandise. A member or plate positioned in the slot supports the card in its position wherein the merchandise is pictorially displayed. The member or plate may be removed through a child actuated lever mechanism to allow disposition of the card behind a plurality of transparent portions of the first panel. The transparent portions of the first panel are configured and adapted for displaying a plurality of numerals when reflection of light is blocked in predetermined parts of the transparent portions. The card has indicia members adapted for blocking reflection of light through predetermined parts of the transparent portions so as to cause the numerical display of a price of the merchandise depicted on the card.

10 Claims, 6 Drawing Figures

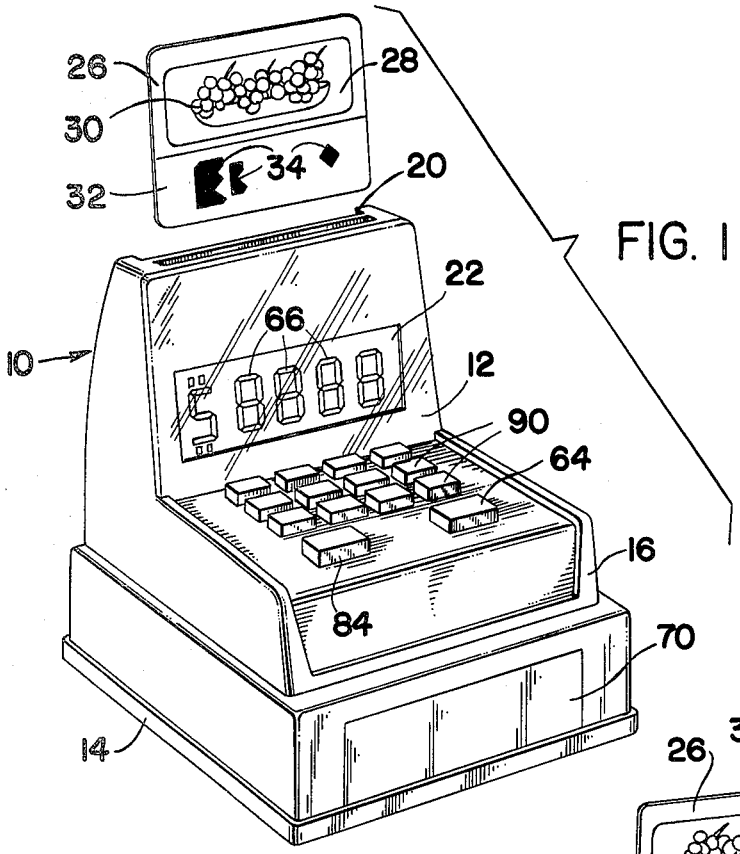
FIG. 1
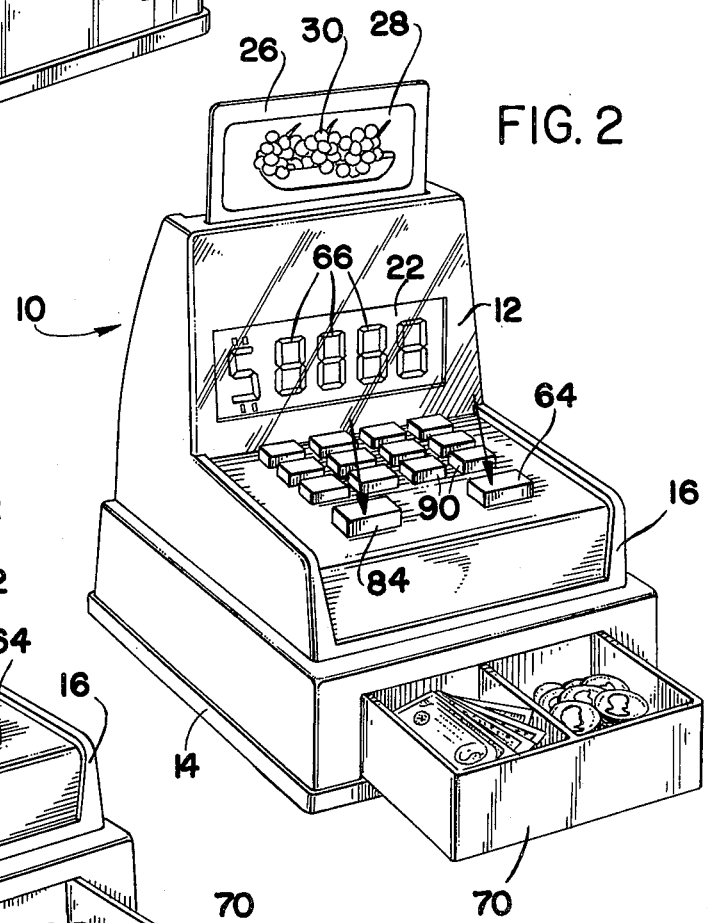
FIG. 2
FIG. 3
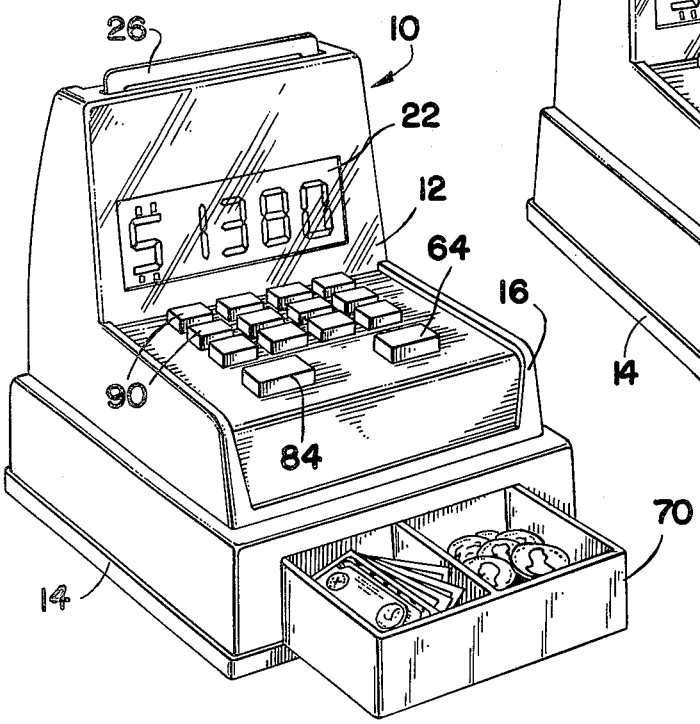

CASH REGISTER TOY

BACKGROUND OF THE INVENTION

1. Field of the Invention

The present invention is directed to a cash register toy, and more particularly to a cash register toy capable of receiving a card depicting a specific item or merchandise, and displaying, at the option of a player, the price of the merchandise.

2. Brief Description of the Prior Art

The prior art is aware of cash register toys of various kinds. Cash register toys of the prior art typically include a chassis configured to simulate a cash register and a drawer which is partially ejected from the chassis when a player actuates a suitable release mechanism. Prior art cash register toys usually also include a bell which is sounded when the drawer is ejected from the register thereby imitating the sound effect of a real cash register.

One particular cash register toy of the prior art includes a plurality of slots dimensioned to accommodate and accept disk shaped plastic tokens which are used as "money" by a child player with the toy. Only when the right "denomination" of token is placed into one of the slots may the token be advanced by a suitable child actuated mechanism into a drawer located in a lower portion of the cash register toy.

The cash register toy of the present invention is designed to provide an interesting and educational feature in that it is capable of numerically displaying the price of merchandise which is pictorially illustrated on any one of a plurality of cards associated with the toy.

SUMMARY OF THE INVENTION

It is an object of the present invention to provide a cash register toy which is realistic in appearance and function.

It is another object of the present invention to provide a cash register toy which is capable of numerically displaying the price of specific merchandise pictorially illustrated on any one of a plurality of cards associated with the toy.

It is still another object of the present invention to provide a cash register toy wherein the price of a specific merchandise illustrated on a card is numerically displayed at the option of the player.

These and other objects and advantages are attained by a toy which has a chassis generally configured to simulate a cash register. A mechanism for receiving a card pictorially depicting specific merchandise includes a panel having a plurality of transparent or cut-out portions which are capable of displaying a plurality of numerals when reflection of light is blocked through predetermined parts of the transparent or cut-out portions. The card has indicia members affixed thereto which correspond to the price of the merchandise shown on the card. When the card is inserted behind the panel, the indicia members block refraction of light in a predetermined pattern through parts of the transparent or cut-out portions so that the price of the merchandise is visually displayed on the panel.

The objects and features of the present invention are set forth in the appended claims. The present invention may be best understood by reference to the following description, taken in connection with the accompanying drawings in which like numerals indicate like parts.

BRIEF DESCRIPTION OF THE DRAWINGS

FIG. 1 is a perspective view of the cash register toy of the present invention, the view showing a card prior to insertion into the cash register toy, the card pictorially depicting a specific merchandise and having indicia members carrying information concerning the price of the merchandise;

FIG. 2 is another perspective view of the cash register toy of the present invention, the view showing the card after it has been partially inserted into the cash register toy;

FIG. 3 is still another perspective view of the cash register toy of the present invention, the view showing a numerical display of the price of the merchandise depicted on the card;

DESCRIPTION OF THE PREFERRED EMBODIMENT

Figure 4:
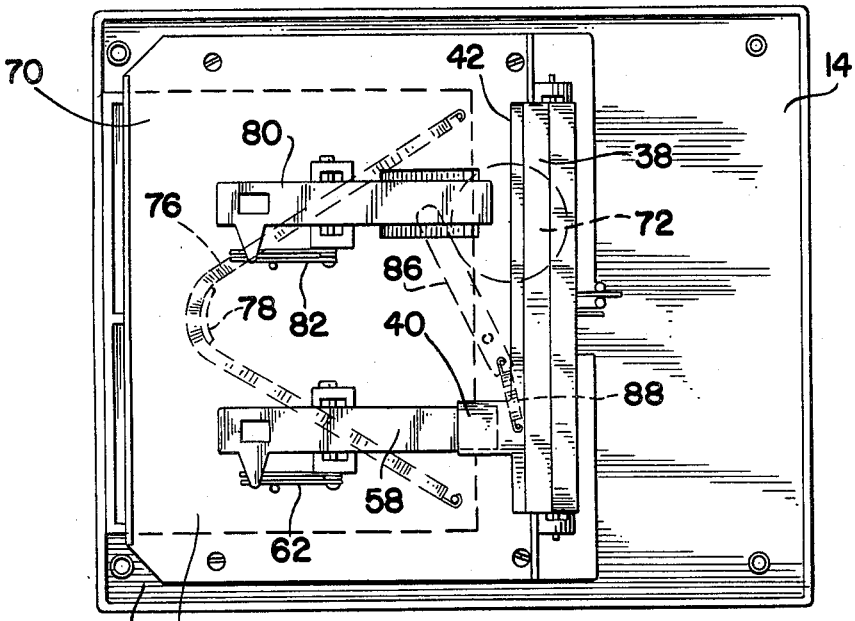
FIG. 4 is a top view of a lower housing shell of the cash register toy of the present invention.
Figure 4:
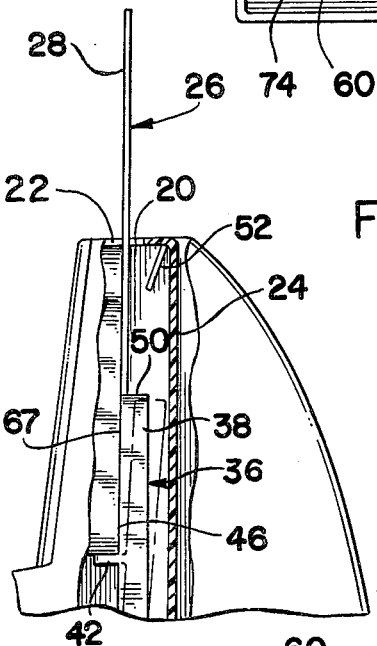

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventor for carrying out his invention in a commercial environment although it should be understood that various modifications can be accomplished within the scope of the present invention.

Referring now to the drawing figures and particularly to the perspective view of FIGS. 1, 2 and 3, a preferred embodiment of the cash register toy 10 of the present invention is disclosed. The cash register toy 10 has a chassis or housing 12 which is generally configured to simulate a real cash register. The chassis 12 includes a lower housing shell 14, best shown on FIG. 4, and an upper housing shell 16. The upper and lower housing shells 14 and 16 are attached to one another by a plurality of screws (not shown) which are engaged in a plurality of threaded apertures (not shown) provided in the upper housing shell 16.

Figure 5:
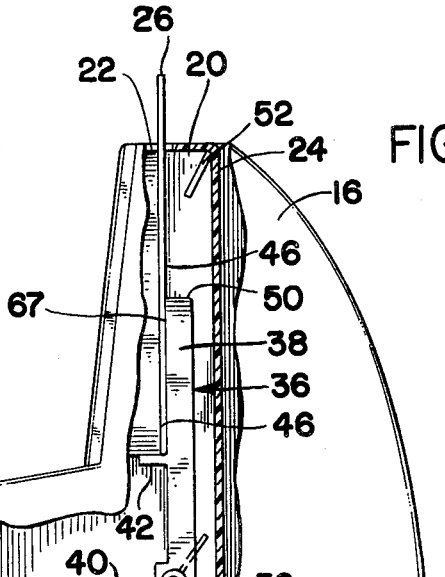
FIG. 5 is a side view, partly in cross section, of the cash register toy of the present invention, with part of an upper housing being broken away.
Figure 6:
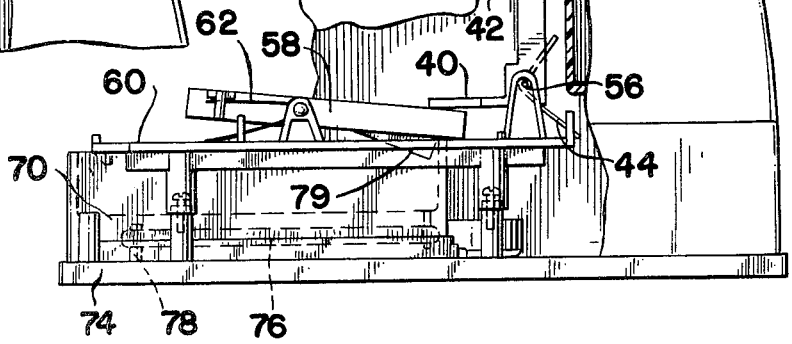
FIG. 6 is a partial side view partly in cross section, showing a mechanism adapted for positioning the card in the cash register toy.

A slot 20 is defined in the upper housing shell 16 by two substantially vertically disposed panels 22 and 24 which are best shown on FIGS. 5 and 6. A first panel of the two substantially vertically disposed panels is also shown on FIGS. 1, 2 and 3 as a numerical display panel and bears the reference numeral 22. The specific construction of the first or numerical display panel 22 is described in detail below in conjunction with the description of FIGS. 1, 2 and 3.

A plurality of cards 26 are provided with the cash register toy 10 of the present invention. Each card 26 depicts in a top portion 28 thereof a specific merchandise. For example, the card 26 shown on FIGS. 1 and 2 depicts grapes 30.

A lower portion 32 of each card 26 has a plurality of indicia members 34. These indicia members 34 carry information concerning a price of the specific merchandise depicted on the card 26. For example, the indicia members 34 of the card 26 shown on FIGS. 1 and 2 carry information to the effect that the price of the grapes 30 pictorially shown on the card 26 is $13.80. This information is, however, not apparent to a child (not shown) who plays with the cash register toy 10 of the present invention. When the child player (not shown) however, places the card 26 into the slot 20 and thereafter actuates a visual display mechanism 36 which coacts with the indicia members 34 of the card 26, then the price of the merchandise is visually displayed on the first panel 22. This is shown on FIG. 3.

Referring now principally to FIGS. 5 and 6, placement of the card 26 within the slot 20, operation of the visual display mechanism 36 and its actuation by a child player (not shown) is disclosed in detail. A plate like member or plate 38 is positioned within the slot 20. The plate 38 has a substantially horizontally disposed orthogonal portion 40 and an intermediate portion 42 which is disposed transversely in the slot 20. The plate 38 is biased by a first wire spring 44 to occupy a first position wherein the plate 38 is in contact with a rear surface 46 of the first panel 22. This first position of the plate 38 is shown with solid lines on FIG. 5.

In the first position of the plate 38, full entry of the card 26 into the slot 20 is blocked by the plate 38. The card 26 may however still be partially inserted into the slot 20, as shown on FIG. 5, so that it is supported by an upper end 50 of the plate 38. This first position on the card 26 within the slot 20 is also shown on the perspective view of FIG. 2. A guide plate 52 is disposed in the slot 20 to prevent the card 26 from accidentally slipping behind the plate 38 into the slot 20. Thus, in the first position of the card 26 within the slot 20, the lower portion 32 of the card 26 containing the indicia members 34 is hidden from view. The top portion 28 of the card 26 pictorially depicting the specific merchandise is still, however, in full view as is shown on FIG. 2.

With principal reference now to FIG. 6, positioning of the card 26 in a second position wherein the price of the specific merchandise is numerically displayed on the first or numerical display panel 22, is explained in detail. The plate 38 is pivotably mounted within the slot 20. A pivot pin 56 mounted substantially adjacent to the orthogonal portion 40 of the plate 38 is shown in FIG. 6.

A first lever 58 engages the orthogonal portion 40 of the plate 38. The first lever 58 is pivotably mounted relative to a substantially horizontally disposed mounting plate 60 of the lower housing shell 14. The first lever 58 is biased by a second wire spring 62 so as to allow the plate 38 to stay in its first position wherein the plate 38 is urged by the first wire spring 44 against the rear surface 46 of the first panel 22.

A child player (not shown) has access to the first lever 58 through a first actuating button 64. The first actuating button 64 is shown on FIGS. 1, 2 and 3. It is readily apparent from the above description that when the child player (not shown) depresses the first actuating button 64, as shown by an arrow on FIG. 2, the first lever 58 moves the orthogonal portion 40 of the plate 38 in an upward direction. Consequently, the plate 38 moves backward in the slot 20, as is shown by phantom lines on FIG. 5, and allows the card 26 to drop into the slot 20 to occupy a second position therein.

When pressure is released on the first actuating button 64, the first lever 58 and the plate 38 return to their respective positions which they normally occupy under bias of the respective first and second wire springs 44 and 62. The card 26 in its second position within the slot 20, shown on FIG. 6, is supported by the transverse intermediate portion 42 of the plate 38. Furthermore, it is pressed to the rear surface 46 of the first panel 22 by the spring biased plate 38. This second position of the card 26 is also shown in the perspective view of FIG. 3.

The price corresponding to the merchandise pictorially depicted on the card 26 is numerically displayed, as shown on FIG. 3, in the just described second position of the card 26. In order to enable the cash register toy 10 of the present invention to numerically display prices of the various merchandise depicted on the several cards 26 associated with the toy 10, the first or display panel 22 and the coacting indicia members 34 are constructed in the following manner.

The first panel 22 is provided with a plurality of transparent portions 66 which are arranged in a predetermined configuration so to enable display of a plurality of arabic numerals when reflection of light is selectively blocked behind some of the transparent portions. More specifically, the transparent portions 66 are provided in the configuration of four stylized and substantially square shaped figures of eight. These are shown on FIGS. 1 and 2.

A front surface 67 of the plate 38 in contact with the rear surface 46 of the first panel 22 has good light reflecting properties. Therefore, as the plate 38 is pressed to the rear surface 46 of the first panel 22, the four figures of eight, shown on FIGS. 1 and 2, are seen by a player. The indicia members 34 of each card 26 are designed to interface with the transparent portions 66 of the first panel 22 when the card 26 is positoned in its respective second position in the slot 20. In this position, the indicia members 34 of each card 26 are disposed behind selected predetermined parts of the transparent portions 66 of the first panel. Because the indicia members 34 have a light absorbing black or substantially black surface, they block or eliminate reflection of light in the selected parts of the transparent portions 66. The remaining transparent portions 66 still have light passing through them because light is reflected from the substantially white surface 68 of the lower portion 32 of the card 26. The transparent portions 66 still passing light display a desired four digit figure which indicates the price of the merchandise depicted on the top portion 28 of the respective card 26.

In the herein described specific embodiment of the cash register toy 10 of the present invention, the first or display panel 22 is a substantially nontransparent black glass or plastic plate, the transparent portions 66 comprise transparent orange colored glass or plastic and the indicia members 34 of the cards 26 comprise black markings. In alternative embodiment of the cash register toy 10 of the present invention, the transparent portions 66 may simply comprise cut-out portions (not shown) in the otherwise substantially nontransparent display panel. It should be readily apparent in light of the above description that any four digit numeral or figure may be displayed by the herein described specific embodiment of the cash register toy 10 of the present invention. In alternative embodiments, the first panel 22 may be adapted to display figures of any desired number of digits.

Referring again principally to FIGS. 4 and 6, a drawer 70 partially ejectable from the chassis 12 of the cash register toy 10, and an associated bell 72 are disclosed. The ejectable drawer 70 and the bell 72 provide additional play options to a child user of the toy 10 of the present invention, and further enhance the realistic appearance and function of the toy 10.

The drawer 70, shown on FIGS. 4 and 6 with phantom lines, is mounted to slide between a bottom plate 74 and the mounting plate 60 of the lower housing shell 14. The drawer 70 is permanently urged to slide out of the chassis 12 by a coil spring 76. The coil spring 76 is attached to the drawer 70 at two points and kept under tension by a protruding portion or post 78 of the bottom plate 74. A pawl member 79 attached to an end of a second lever 80 engages the drawer 70 and keeps it from sliding out of the chassis 12 under the bias of the coil spring 76. The pawl member 79 is shown with phantom lines on FIG. 6. The second lever 80 is pivotably mounted to the mounting plate 60 and is biased by a third wire spring 82 so that the pawl member 79 stays in engagement with the drawer 70. A child playing with the toy 10 may, at his option, press a second actuating button 84, shown on FIGS. 1, 2 and 3, thereby moving the second lever 80 and the pawl 79 out of engagement with the drawer 70. As a result, the drawer 70 suddenly slides out of the chassis 12 in simulation of a real cash register.

A second pawl member (not shown) is mounted to the bottom of the drawer 70. As the drawer 70 slides out of the chassis 12 under the force of the coil spring 76, the second pawl member (not shown) cocks a spring biased striker 86. The striker 86 and a spring 88 biasing the same are shown with phantom lines on FIG. 4. As the striker 86 is released by the second pawl member (not shown), it strikes and rings the bell 72 which is mounted to the bottom plate 74 of the lower housing shell 14.

In light of the above description it is readily apparent that a child playing with the cash register toy 10 of the present invention may select any one of the cards 26 from the plurality of cards 26 which are associated with the toy 10. The child may then place the card 26 in its first position in the slot 20 whereby the merchandise depicted on the card 26 becomes clearly visible, as is shown on FIG. 2. In order to register the "price" of the merchandise the child merely depresses the first actuating button 64 whereby the card 26 simply drops into its second position and the price is numerically displayed, as shown on FIG. 3. As an additional play option, the child may depress the second actuating button 84 thereby releasing the drawer 70 and activating the bell 72. In order to still further enhance the realistic appearance of the cash register toy 10 of the present invention, a plurality of nonfunctioning actuating buttons 90 are provided in the chassis 12. These nonfunctioning buttons 90 effectively simulate a numerical keyboard of a real cash register.

What has been described above is a cash register toy which is capable of numerically displaying the price of specific items or merchandise shown on cards associated with the toy. Several modifications of the present invention may become readily apparent to those skilled in the toy manufacturing arts in light of the above disclosed generic principles. Accordingly, the scope of the present invention should be interpreted solely from the following claims.

What is claimed is:

1. A combination of a cash register simulating toy with at least one card, the combination comprising:

a card having a pictorial representation of a specific merchandise thereon, and encoded graphic indicia markings carrying information corresponding to a price of the merchandise, the encoded indicia markings not being directly readable as numerals;

a chassis generally configured to simulate a cash register;

a first substantially upright panel and a second substantially upright panel included in the chassis, the first and second panels being in a spaced relationship relative to one another and defining a slot wherein the card may be at least partially placed, the first panel including a substantially nontransparent window area having a substantially light transparent matrix, a surface of the second panel located behind the matrix being a light reflective surface, and an actuating member actuable by a child player, mounted for at least limited pivoting motion relative to the chassis and having a portion disposed transversely in the slot defined by the first and second panel, the encoded indicia markings of the card cooperating with the matrix and the light reflecting surface to display a numerical value of the price of the merchandise when the card is inserted into an operative position in the slot; the portion of the actuating member selectively blocking and allowing entry of the card into the operative position in the slot at an option of the player.

2. The combination of claim 1 comprising a plurality of cards.

3. The combination of claim 1 wherein the pictorial representation on the card is disposed so that it is not visible when the card is in the operative position in the slot.

4. The combination of claim 1 wherein the slot is adapted to receive the card in a second position other than the operating position, in the second position the card being supported by the portion of the actuating member and the pictorial representation of the specific merchandise being exposed to view in the second position of the card.

5. A toy comprising a chassis configured to simulate a cash register, including a surface having a plurality of buttons mounted thereto, the surface and the buttons simulating the key board of a cash register, and including a substantially upright portion;

a window disposed in the upright portion and exposed to view by a player;

a first substantially nontransparent panel incorporated in the window in view of the player and having a light transparent matrix;

a second panel disposed behind the first panel in a spaced substantially parallel relationship to the first panel so that a slot is defined between the first and second panels, a surface of the second panel located behind the matrix being a light reflecting surface, the slot being adapted to receive a card having indicia members pictorially depicting a specific merchandise, the card also having encoded indicia markings carrying information regarding price of the merchandise, the encoded indicia markings, the light reflecting surface and the matrix being adapted for displaying a numerical value of the price of the merchandise when the indicia markings are positioned behind the matrix and between the first and second panels, and actuating means operable by a player for positioning the encoded indicia markings of the card behind the matrix and between the first and second panels.

6. The invention of claim 5 wherein the actuating means are also adapted for optionally positioning the card in the slot in a position wherein the indicia members depicting the merchandise are displayed for view by a player and wherein the numerical price of the merchandise is not displayed through the matrix in the window.

7. The invention of claim 6 wherein the actuating means include a member pivotably positioned in the slot and blocking the slot in an intermediate portion thereof so as to support the card in the position wherein the indicia members depicting the merchandise are displayed, the member being connected to a lever actuable by the player to move the member from blocking the slot whereby the card may drop into the position wherein the numerical value of the price of the merchandise is displayed through the matrix in the window.

8. The invention of claim 7 wherein the member in the slot is spring biased to occupy the position wherein the member blocks the slot, said spring biased member acting to press the card to the first panel when the card is in the position to display the numerical value of the price of the merchandise.

9. The invention of claim 8 further comprising a drawer slidingly mounted into the chassis, and means for partially ejecting the drawer from the chassis at the option of a player.

10. The invention of claim 9 wherein the means for partially ejecting a spring biasing the drawer to slide out of the chassis and a pivotable lever having a pawl engaging the drawer and holding the same in the chassis against the spring bias, the pivotable lever being actuable by the player to disengage the pawl from the drawer whereby the drawer slides out of the chassis under the bias of the spring.

* * * * *